US012644456B2

(12) United States Patent
Chen et al.

(10) Patent No.: US 12,644,456 B2
(45) Date of Patent: Jun. 2, 2026

(54) COMPRESSOR STRUCTURE

(71) Applicant: Fu Sheng Industrial Co. Ltd., Taipei City (TW)

(72) Inventors: Taiyu Chen, Taipei City (TW); Yu-Feng Wu, Taipei City (TW)

(73) Assignee: Fu Sheng Industrial Co. Ltd., Taipei City (TW)

( * ) Notice: Subject to any disclaimer, the term of this patent is extended or adjusted under 35 U.S.C. 154(b) by 0 days.

(21) Appl. No.: 19/277,339

(22) Filed: Jul. 22, 2025

(65) Prior Publication Data

US 2026/0146609 A1 May 28, 2026

(30) Foreign Application Priority Data

Nov. 22, 2024 (TW) ..... 113145167

(51) Int. Cl.
*F04C 29/02* (2006.01)
*F04C 18/16* (2006.01)
*F04C 29/04* (2006.01)

(52) U.S. Cl.
CPC ..... *F04C 29/026* (2013.01); *F04C 18/16* (2013.01); *F04C 29/04* (2013.01); *F04C 2240/30* (2013.01)

(58) Field of Classification Search
CPC ..... F04C 29/026; F04C 18/16; F04C 29/04; F04C 2240/30
See application file for complete search history.

(56) References Cited

U.S. PATENT DOCUMENTS 1,973,063 A * 9/1934 Grier ..... F04C 29/026 418/82
2002/0104296 A1* 8/2002 Cook ..... F04C 23/00 55/467

(Continued)

FOREIGN PATENT DOCUMENTS

| | | |
|---|---|---|
| CA | 2363745 | 8/2002 |
| CN | 101943163 | 1/2011 |
| CN | 202646015 | 1/2013 |

(Continued)

OTHER PUBLICATIONS

"Search Report of Europe Counterpart Application", issued on Jan. 2, 2026, p. 1-p. 9.

(Continued)

*Primary Examiner* — Shafiq Mian
(74) *Attorney, Agent, or Firm* — JCIPRNET

(57) ABSTRACT

Provided is a compressor structure, which includes a compressor housing, an oil tank, an oil-gas barrel, a motor, a first assembly base, at least one oil filter, a second assembly base, and at least one oil mist separator. The compressor housing has a compression chamber. The compressor housing, the oil tank, and the oil-gas barrel are integrally cast and formed. The first assembly base has an oil-gas flow passage, and the compression chamber is communicated with the oil-gas barrel through the oil-gas flow passage. The oil filter is disposed on the first assembly base and communicates with the compression chamber through the first assembly base. The second assembly base is disposed on the oil-gas barrel. The oil mist separator is disposed on the second assembly base and communicates with the oil-gas barrel through the second assembly base.

20 Claims, 13 Drawing Sheets

(56) References Cited

U.S. PATENT DOCUMENTS

| | | | | |
|---|---|---|---|---|
| 2005/0217221 | A1* | 10/2005 | Stickland | F04C 29/026 55/319 |
| 2020/0309133 | A1* | 10/2020 | Argentini | F17C 1/14 |

FOREIGN PATENT DOCUMENTS

| | | |
|---|---|---|
| CN | 204532821 | 8/2015 |
| CN | 110678654 | 1/2020 |
| CN | 218325297 | 1/2023 |
| CN | 218467841 | 2/2023 |
| EP | 1229249 | 8/2002 |
| EP | 3719322 | 10/2020 |
| JP | 2002070778 | 3/2002 |
| TW | M667785 | 3/2025 |

OTHER PUBLICATIONS

"Office Action of Taiwan Counterpart Application", issued on Sep. 8, 2025, p. 1-p. 7.

* cited by examiner

COMPRESSOR STRUCTURE

CROSS-REFERENCE TO RELATED APPLICATION

This application claims the priority benefit of Taiwan application serial no. 113145167, filed on Nov. 22, 2024. The entirety of the above-mentioned patent application is hereby incorporated by reference herein and made a part of this specification.

BACKGROUND

Technical Field

The disclosure relates to a compressor structure, and particularly relates to a compressor structure having an oil-gas separation design.

Related Art

Screw compressors may be generally classified into oil-injected screw compressors and oil-free screw compressors. Although oil-free screw compressors can provide completely oil-free gas, needs for gas quality are higher, maintenance difficulty is high, and manufacturing costs are high. Therefore, oil-free screw compressors are not as widely applied as oil-injected screw compressors.

During an operation of an oil-injected screw compressor, a lubricating oil is injected into a compression chamber to perform lubrication and cooling on a rotor in the compression chamber, thereby reducing an operation temperature. First, the lubricating oil injected into the compression chamber may mix with a gas entering the compression chamber and be compressed by the rotor. Next, a mixed fluid formed by the lubricating oil and the compressed gas is discharged from the compression chamber and enters an oil tank. When the mixed fluid enters the oil tank, the mixed fluid may hit an inner wall of the oil tank or other components in the oil tank to perform preliminary separation on the lubricating oil and the compressed gas. However, the separation effect is generally poor, resulting in a gas with high oil content entering a system and increasing a consumption of the lubricating oil.

SUMMARY

The disclosure provides a compressor structure, which facilitates an enhancement of an oil-gas separation effect.

The disclosure provides a compressor structure, which includes a compressor housing, an oil tank, an oil-gas barrel, a motor, a first assembly base, at least one oil filter, a second assembly base, and at least one oil mist separator. The compressor housing has a compression chamber. The oil-gas barrel is integrally cast and formed with the compressor housing and the oil tank. The first assembly base is respectively disposed on opposite sides of the compressor housing with the motor. The first assembly base has an oil-gas flow passage. The compression chamber is communicated with the oil-gas barrel through the oil-gas flow passage. The at least one oil filter is disposed on the first assembly base and communicates with the compression chamber through the first assembly base. The second assembly base is disposed on the oil-gas barrel. The at least one oil mist separator is disposed on the second assembly base and communicates with the oil-gas barrel through the second assembly base.

Based on the above, in the compressor structure of the disclosure, a mixed fluid formed by a lubricating oil and a compressed gas may sequentially perform oil-gas separation in the oil-gas flow passage and in the oil-gas barrel after being discharged from the compression chamber to separate most of the lubricating oil from the compressed gas before entering the oil tank and the oil-gas barrel for storage. Therefore, the compressor structure of the disclosure can not only prevent a compressed gas with high oil content from entering a system, but also can decrease a consumption of the lubricating oil. On the other hand, the compressor housing, the oil tank, and the oil-gas barrel are integrally cast and formed, which can not only significantly improve structural strength, decrease assembly processes, improve manufacturing efficiency and reduce manufacturing costs, but also can improve sealing performance to effectively decrease an oil-gas leakage phenomenon.

In order to make the features and advantages of the disclosure more comprehensible, the following examples are given and described in detail with the accompanying drawings as follows.

DESCRIPTION OF THE EMBODIMENTS

Figure 1A:
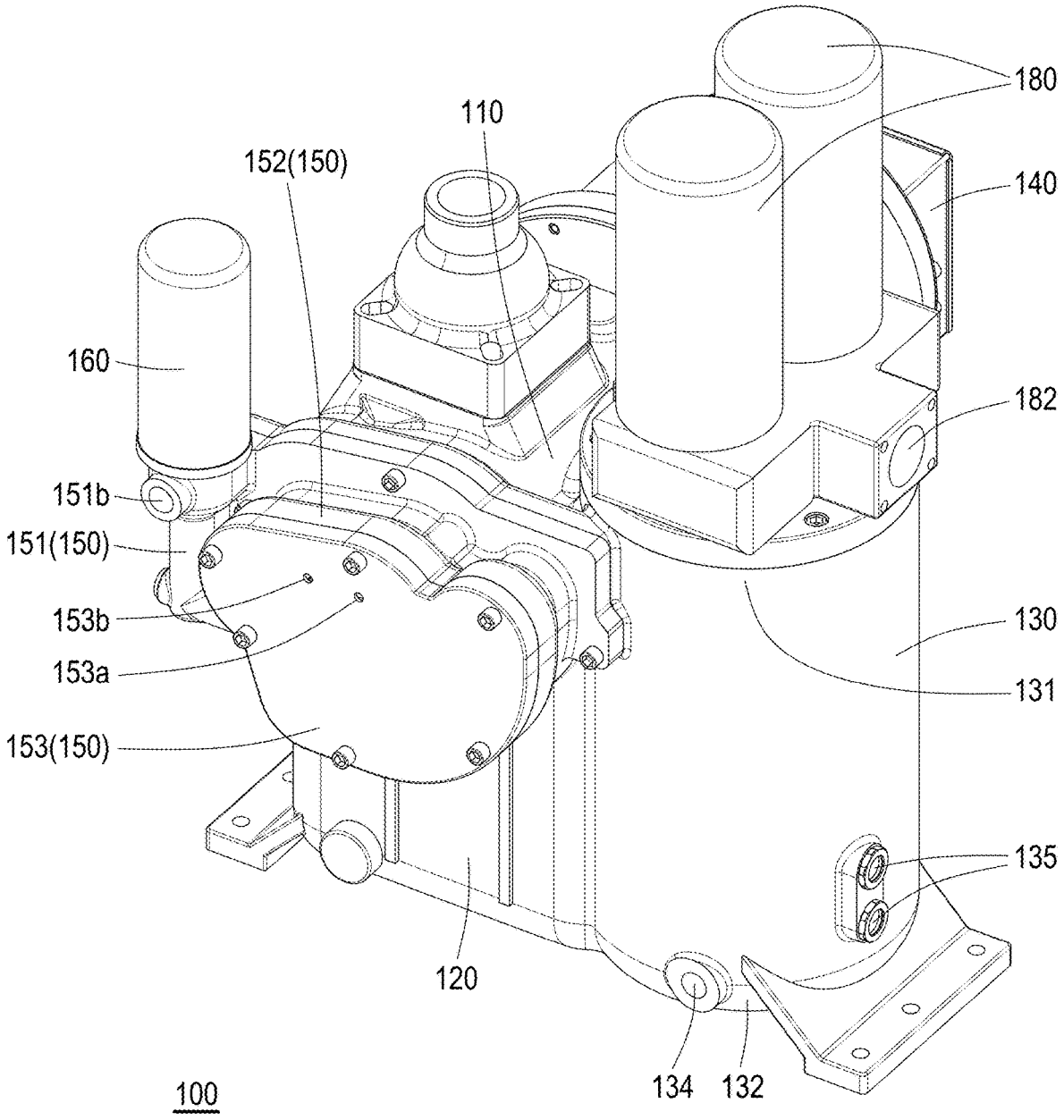
FIG. 1A and FIG. 1B are schematic views of a compressor structure according to an embodiment of the disclosure from two different viewing angles.
Figure 1B:
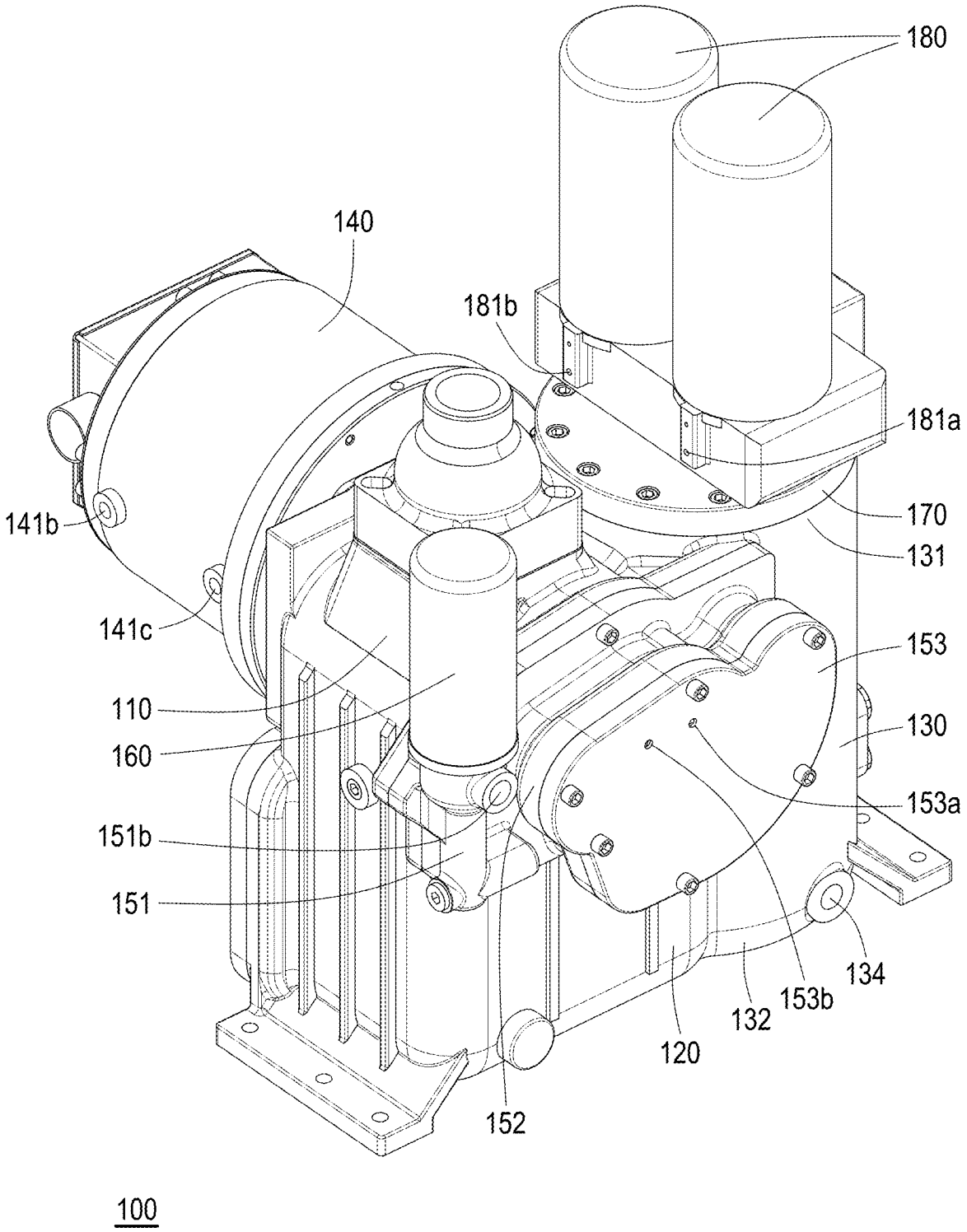

Please refer to FIG. 1A and FIG. 1B. In the embodiment, a compressor structure 100 includes a compressor housing 110, an oil tank 120, an oil-gas barrel 130, a motor 140, a first assembly base 150, at least one oil filter 160, a second assembly base 170, and at least one oil mist separator 180. In detail, the compressor housing 110, the oil tank 120, and the oil-gas barrel 130 are integrally cast and formed, which not only can significantly improve structural strength, decrease assembly processes, improve manufacturing efficiency and reduce manufacturing costs, but also can improve sealing performance to effectively decrease an oil-gas leakage phenomenon. In addition, since the compressor housing 110, the oil tank 120, and the oil-gas barrel 130 are integrally cast, not only can a complex geometric design be implemented, but also a compactness of structural configuration can be enhanced to reduce volume.

As shown in FIG. 1A, FIG. 1B, FIG. 2A and FIG. 2B, the motor 140 and the first assembly base 150 are respectively disposed on opposite sides of the compressor housing 110. The oil filter 160 is disposed on the first assembly base 150 and located on the outside of the first assembly base 150. In addition, the second assembly base 170 is disposed on the oil-gas barrel 130. The oil mist separator 180 is disposed on the second assembly base 170 and located on the outside of the second assembly base 170. Based on the foregoing assembly configuration, the compactness of structural configuration can be enhanced to reduce volume.

For example, the first assembly base 150 may be locked and fixed to the compressor housing 110 through bolts, screws or other locking components. In addition, the second assembly base 170 may be locked and fixed to a top 131 of the oil-gas barrel 130 through bolts, screws or other locking components.

Figure 1C:
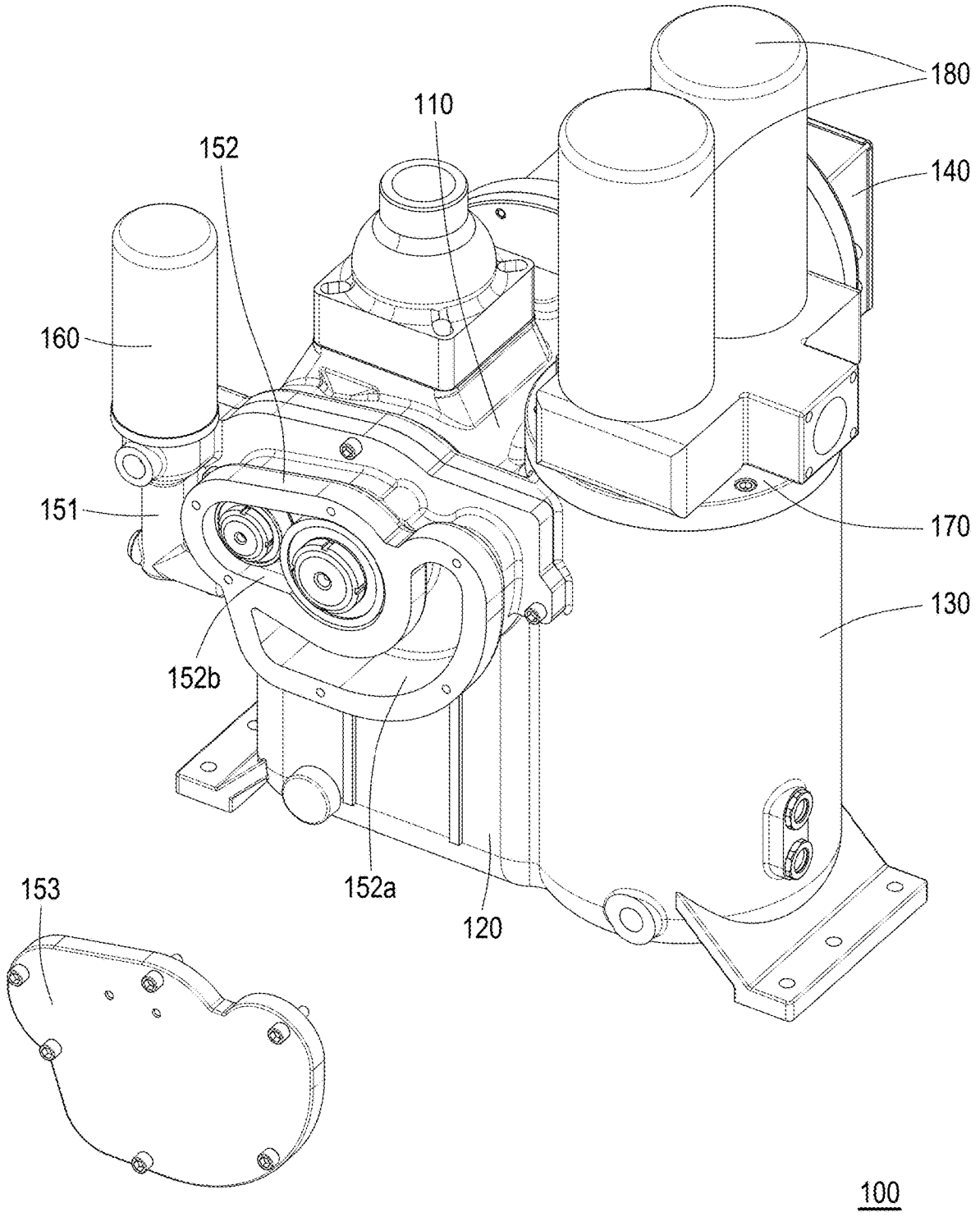
FIG. 1C is a schematic view of the bearing base cover of FIG. 1A being detached from the bearing base.
Figure 1D:
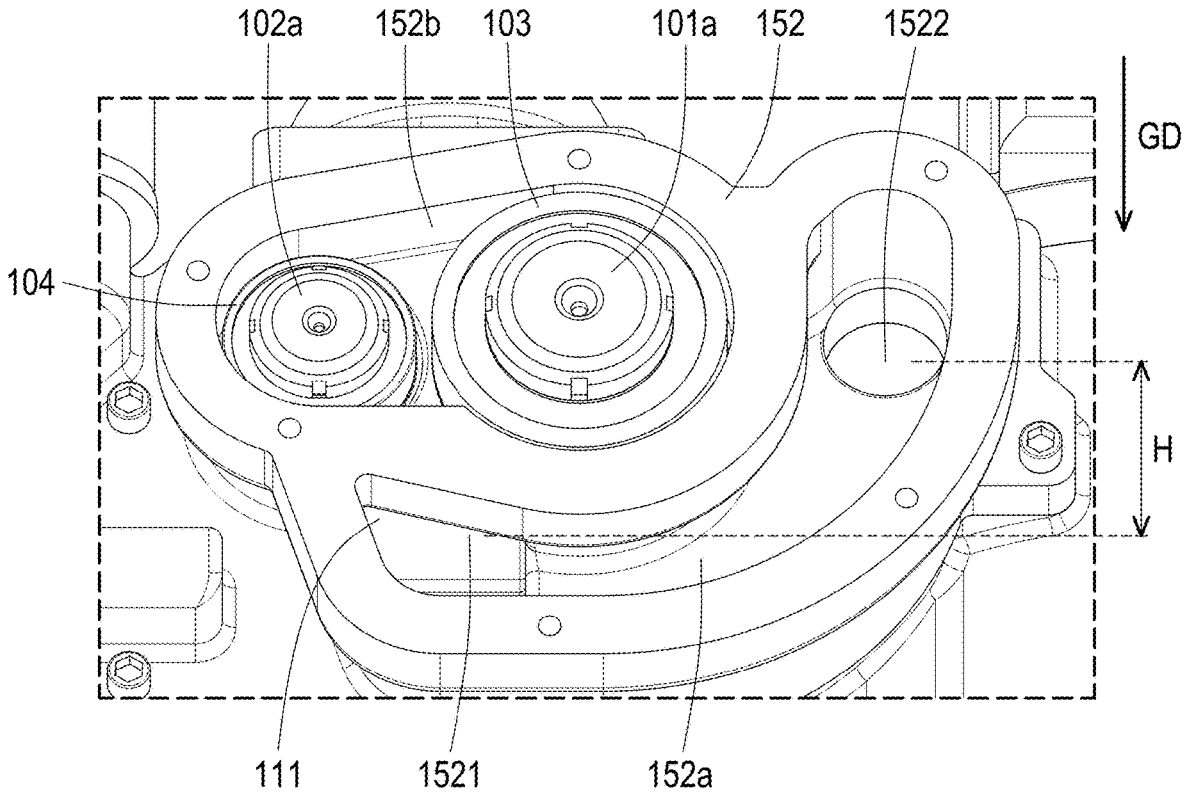
FIG. 1D is a schematic partial enlarged view of the bearing base of FIG. 1C from another viewing angle.

As shown in FIG. 1B to FIG. 1D, the first assembly base 150 includes an oil filter base 151 and a bearing base 152. The oil filter base 151 and the bearing base 152 are integrally cast and formed, which not only can significantly improve structural strength, decrease assembly processes, improve manufacturing efficiency and reduce manufacturing costs, but also can improve sealing performance to effectively decrease the oil-gas leakage phenomenon. In addition, since the oil filter base 151 and the bearing base 152 are integrally cast, not only can the complex geometric design be implemented, but also the compactness of structural configuration can be enhanced to reduce volume.

As shown in FIG. 1D, FIG. 1E, FIG. 2B and FIG. 2C, in the embodiment, the oil filter 160 is disposed on the oil filter base 151. The first assembly base 150 has an oil-gas flow passage 152*a* and a bearing assembly space 152*b* formed in the bearing base 152. In detail, the oil-gas flow passage 152*a* and the bearing assembly space 152*b* are separated from each other. The oil-gas flow passage 152*a* extends toward the oil-gas barrel 130 along an arc path from bottom to top around the bearing assembly space 152*b*. The compression chamber 111 of the compressor housing 110 is communicated with the oil-gas barrel 130 through the oil-gas flow passage 152*a*.

The compressor structure 100 further includes a first rotor 101 and a second rotor 102 disposed in parallel in the compression chamber 111, and a first bearing 103 and a second bearing 104 disposed in parallel in the bearing assembly space 152*b*. The first rotor 101 is coupled to the motor 140. The first rotor 101 and the second rotor 102 may be two screws engaging with each other. On the other hand, an end 101*a* of the first rotor 101 is inserted into the bearing assembly space 152*b*. The first bearing 103 is sleeved on the end 101*a* of the first rotor 101. An end 102*a* of the second rotor 102 is inserted into the bearing assembly space 152*b*. The second bearing 104 is sleeved on the end 102*a* of the second rotor 102.

For example, the first rotor 101 and that second rotor 102 engaging with each other may be disposed horizontally left and right. However, the disclosure is not limited thereto. The first rotor 101 and that second rotor 102 engaging with each other may also be disposed vertically up and down, or disposed with their respective long axes (or rotation axes) having a height difference in a gravity direction GD.

Figure 2A:
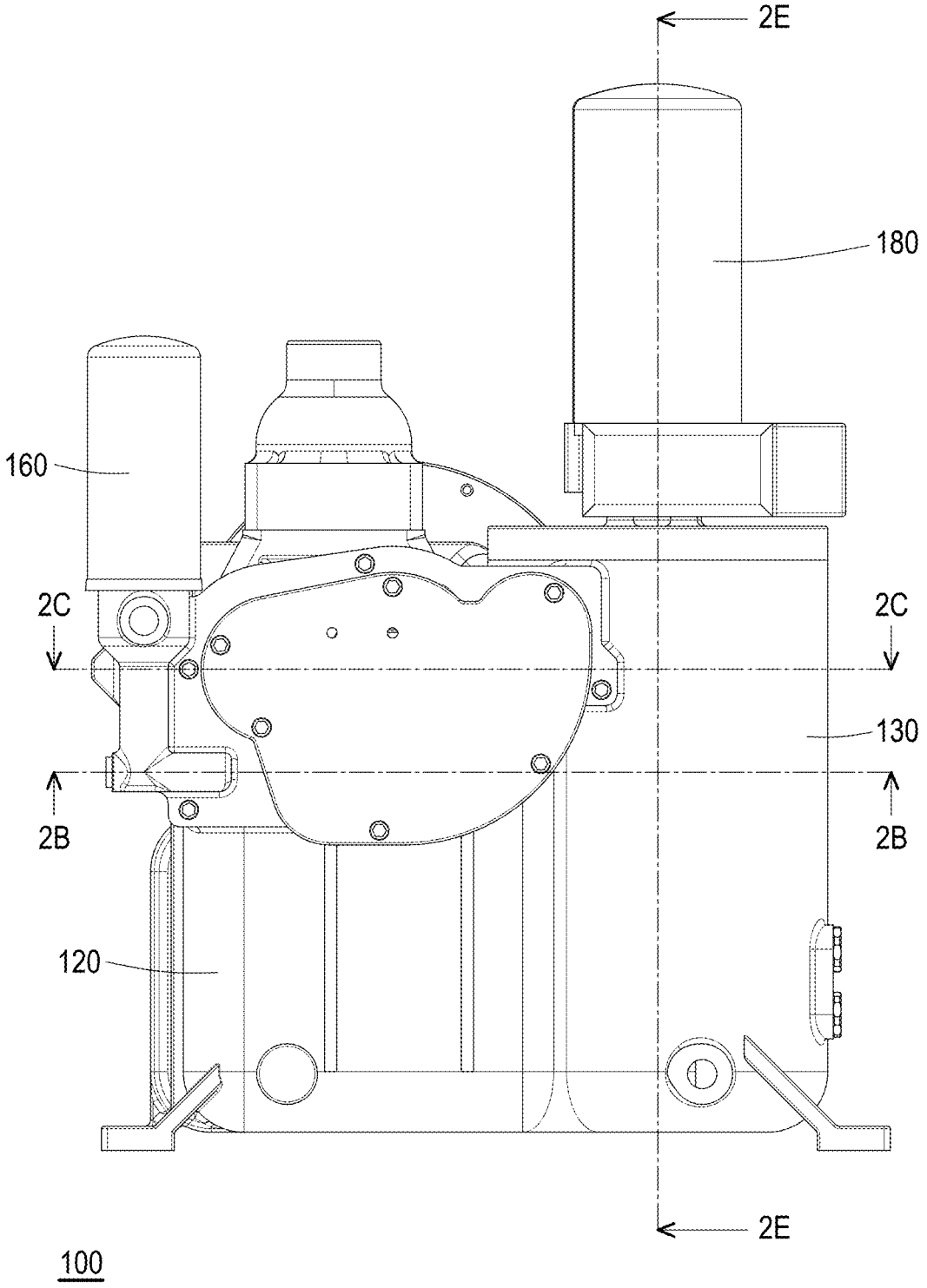
FIG. 2A is a schematic front view of the compressor structure of FIG. 1A.
Figure 2B:
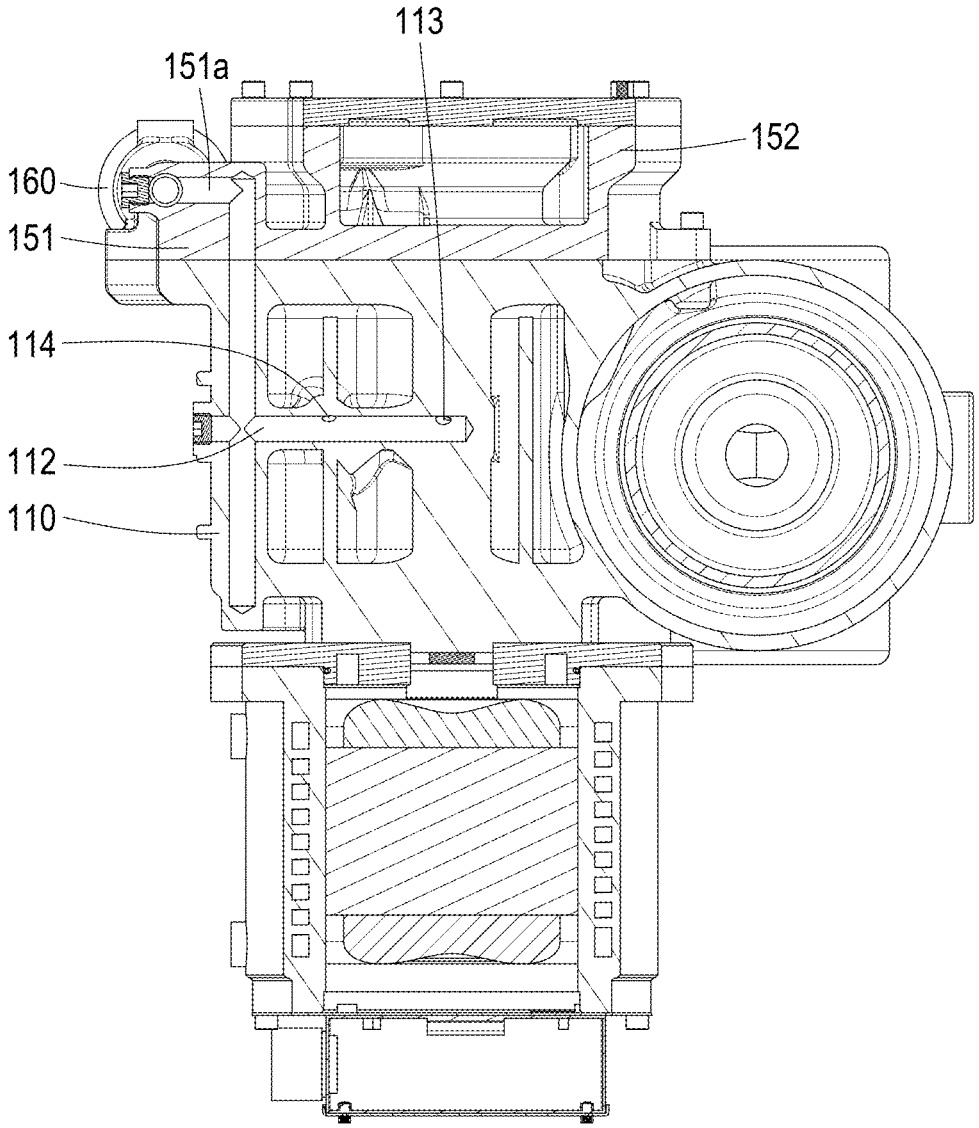
FIG. 2B is a schematic cross-sectional view of FIG. 2A along line segment 2B-2B.
Figure 2C:
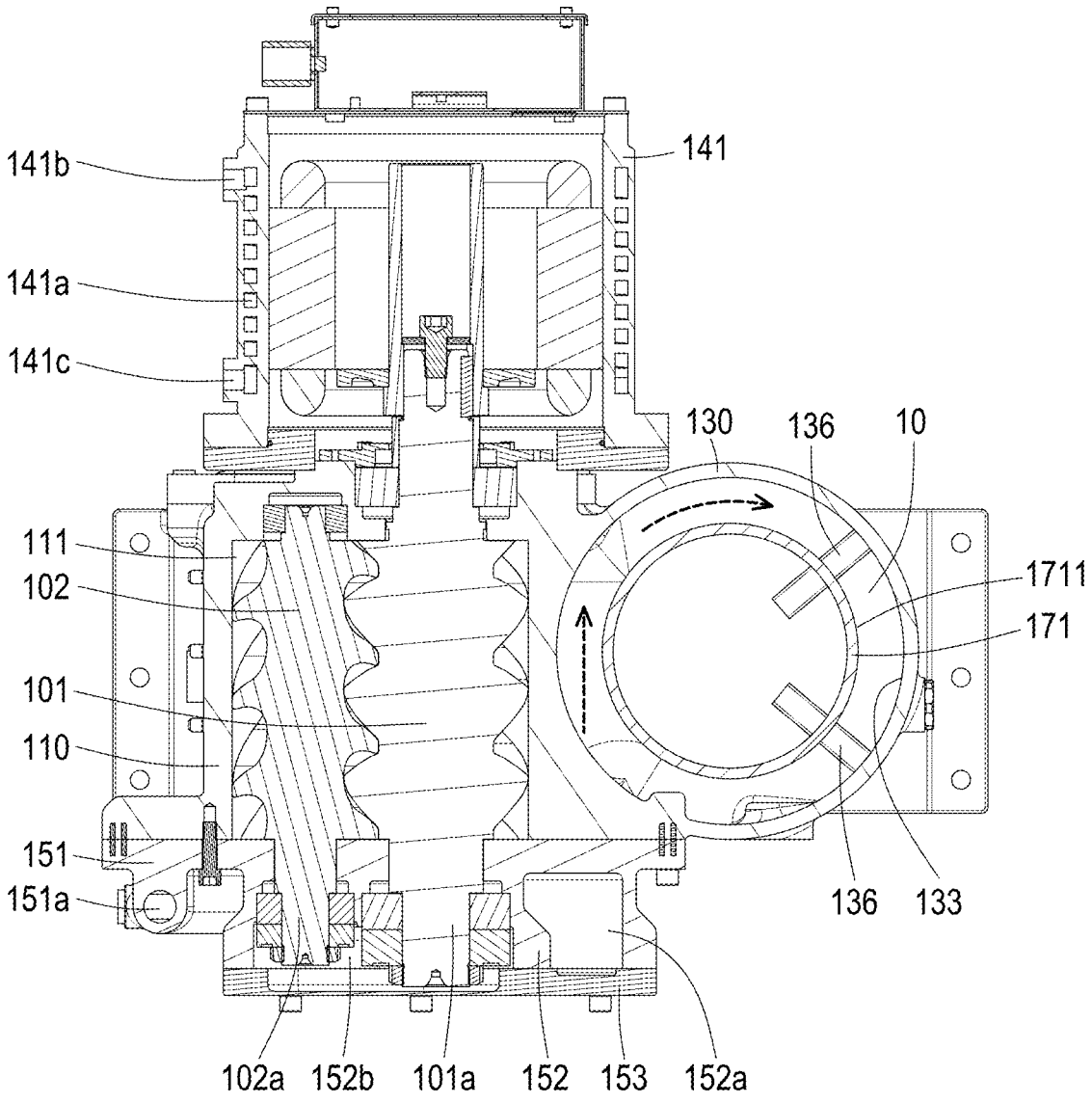
FIG. 2C is a schematic cross-sectional view of FIG. 2A along line segment 2C-2C.

As shown in FIG. 1A, FIG. 1C and FIG. 2C, the first assembly base 150 further includes a bearing base cover 153 disposed on the bearing base 152 to cover or close the bearing assembly space 152*b* and the oil-gas flow passage 152*a*. For example, the bearing base cover 153 may be locked and fixed to the bearing base 152 through bolts, screws or other locking components to cover or close the bearing assembly space 152*b* and the oil-gas flow passage 152*a*, which not only can avoid oil-gas leakage, foreign matter intrusion or moisture intrusion, but also can improve convenience in cleaning, replacement or maintenance.

Figure 1E:
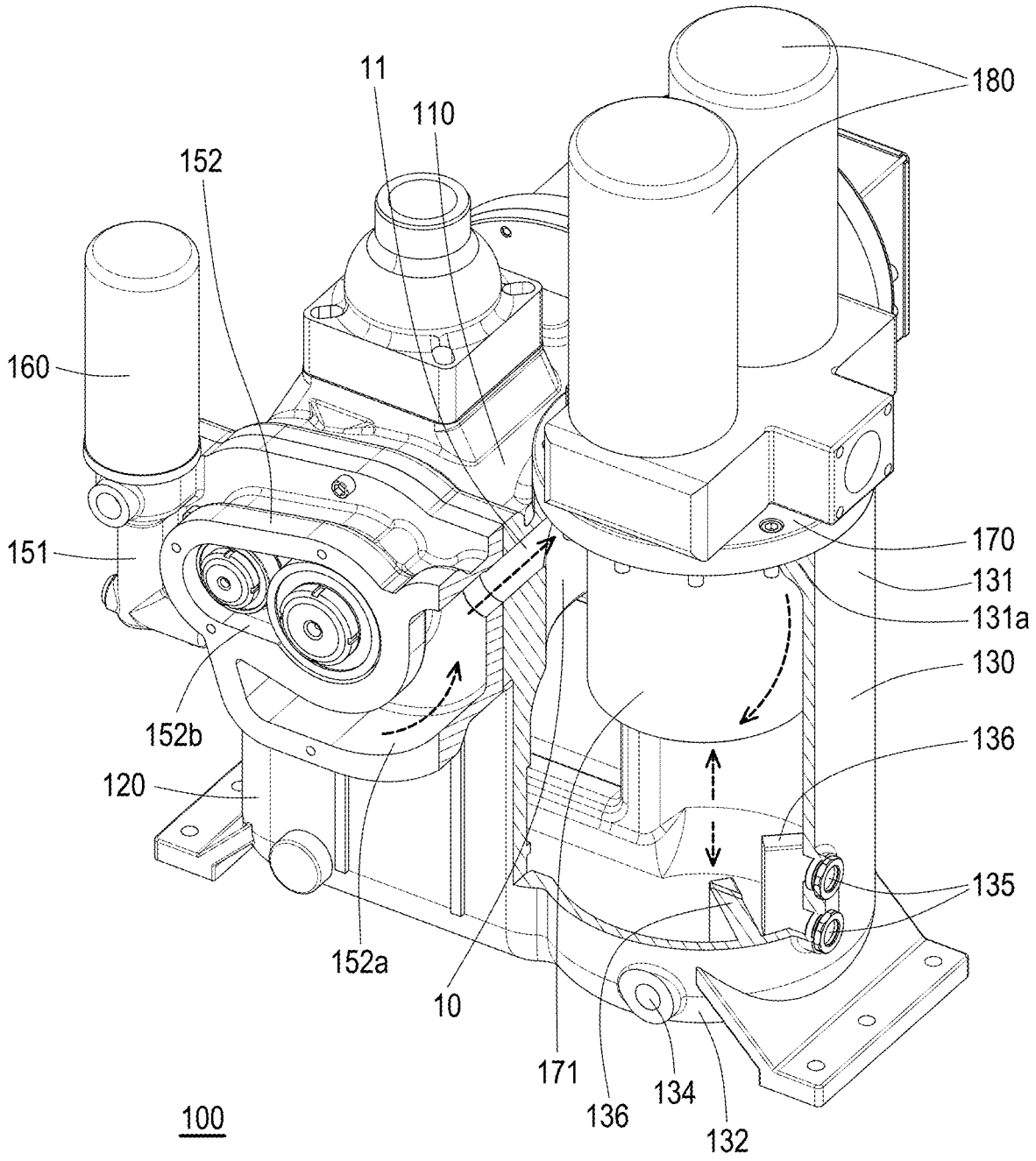
FIG. 1E is a schematic partial cross-sectional view of FIG. 1C.

As shown in FIG. 1A, FIG. 1B and FIG. 1E, the oil tank 120 is disposed under the compressor housing 110. The oil-gas barrel 130 is disposed on a side of the oil tank 120. In addition, the motor 140 and the first assembly base 150 are respectively disposed on opposite sides of the compressor housing 110. The oil-gas barrel 130 communicates with the oil-gas flow passage 152*a* of the bearing base 152 to be disposed opposite to the motor 140 through the bearing base 152.

As shown in FIG. 1C, FIG. 2B, FIG. 2C and FIG. 2D, the oil filter 160 may communicate with the compression chamber 111 through the first assembly base 150, specifically communicating with the compression chamber 111 through the oil filter base 151. In detail, the oil filter base 151 has a first internal oil path 151*a*. The compressor housing 110 further has a second internal oil path 112 communicating with the compression chamber 111. The first internal oil path 151*a* is communicated with the second internal oil path 112. The oil filter 160 is communicated with the compression chamber 111 through the first internal oil path 151*a* and the second internal oil path 112. On the other hand, the compressor housing 110 further has a first oil injection hole 113 disposed corresponding to the first rotor 101 and a second oil injection hole 114 disposed corresponding to the second rotor 102. The second internal oil path 112 is communicated with the compression chamber 111 through the first oil injection hole 113 and the second oil injection hole 114.

First, solid impurities in a lubricating oil may be filtered out through the oil filter 160. Next, the lubricating oil is transported to the first internal oil path 151*a* from the oil filter 160, and then transported to the second internal oil path 112 from the first internal oil path 151*a*. Then, the lubricating oil is injected or sprayed into the compression chamber 111 through the first oil injection hole 113 and the second oil injection hole 114 from the second internal oil path 112 to perform lubrication and cooling on the first rotor 101 and the second rotor 102.

For example, hole axes of the first oil injection hole 113 and the second oil injection hole 114 are not perpendicular to long axes or rotation axes of the first rotor 101 and the second rotor 102, but are inclined to the long axes or the rotation axes the first rotor 101 and the second rotor 102. Therefore, the lubricating oil injecting or spraying into the compression chamber 111 is designed to utilize an oblique injection or an oblique spraying to perform lubrication and cooling of the first rotor 101 and the second rotor 102 over a larger range.

As shown in FIG. 1A, FIG. 1E, FIG. 2C and FIG. 2E, the oil mist separator 180 may communicate with the oil-gas barrel 130 through the second assembly base 170. In detail, the second assembly base 170 includes an oil-gas separation cylinder 171 and a barrel cover 172 connected to the oil-gas separation cylinder 171. The oil-gas separation cylinder 171 and the barrel cover 172 may be integrally formed. The top 131 of the oil-gas barrel 130 has a top opening 131*a*. The second assembly base 170 is disposed on the top 131 and covers or closes the top opening 131*a*. Specifically, the barrel cover 172 covers or closes the top opening 131*a*.

For example, the barrel cover 172 may be locked and fixed to the top 131 of the oil-gas barrel 130 through bolts, screws or other locking components to cover or close an internal space of the oil-gas barrel 130, which not only can avoid oil-gas leakage, foreign matter intrusion or moisture intrusion, but also can improve convenience in cleaning, replacement or maintenance.

Figure 2D:
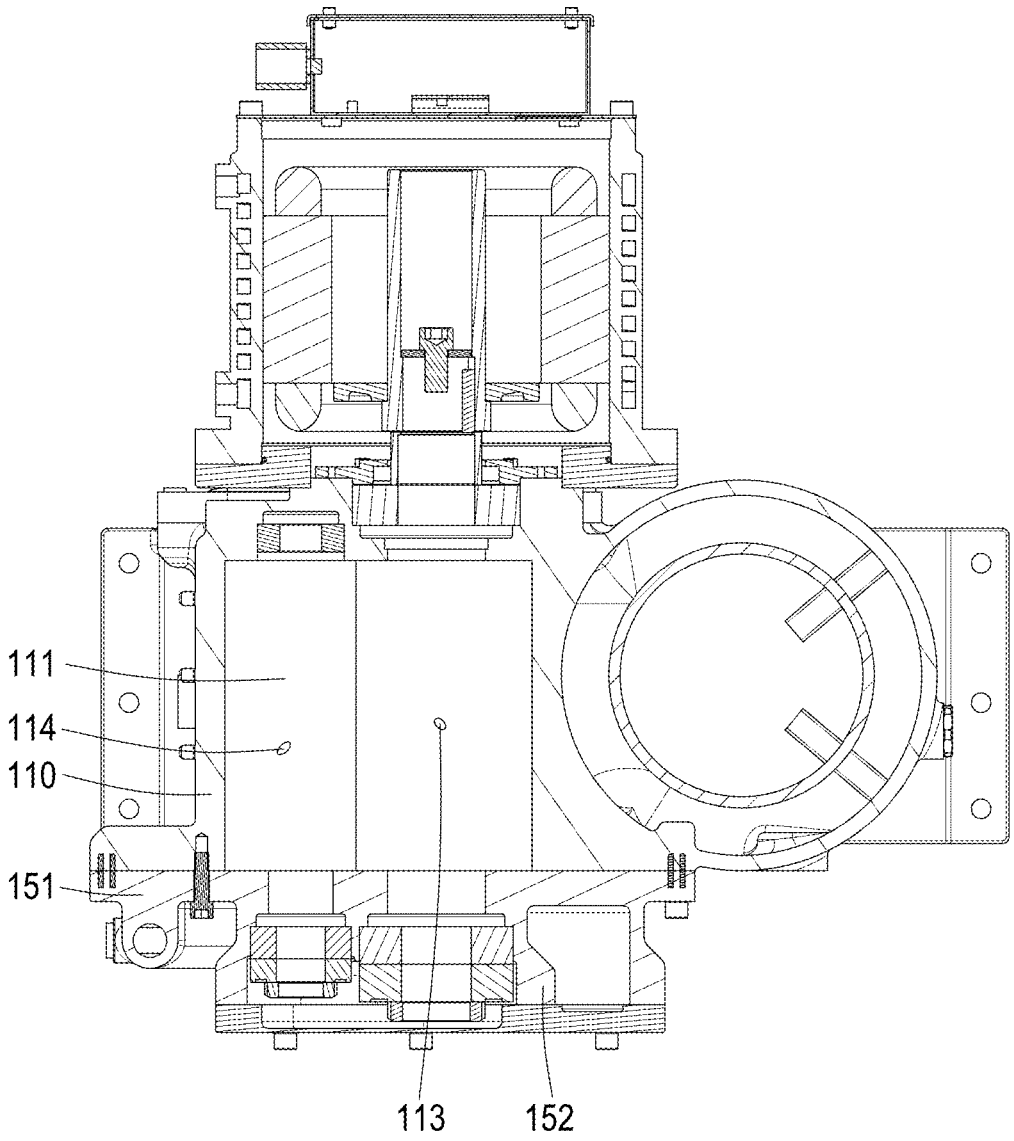
FIG. 2D is a schematic view where the first rotor and the second rotor of FIG. 2C are removed.
Figure 2E:
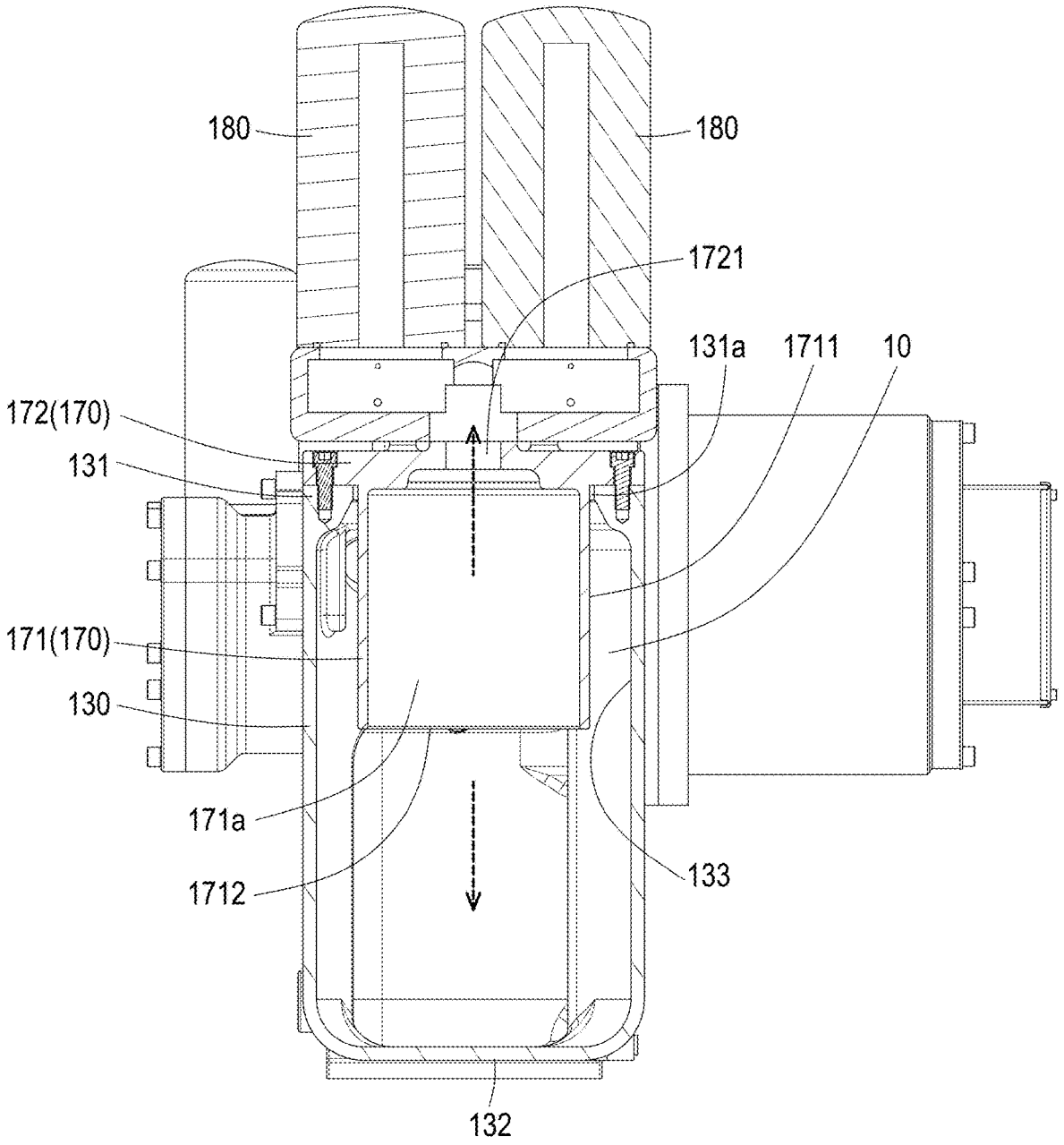
FIG. 2E is a schematic cross-sectional view of FIG. 2A along line segment 2E-2E.

As shown in FIG. 1E, FIG. 2C and FIG. 2E, the oil-gas separation cylinder 171 is inserted into the oil-gas barrel 130 from the top opening 131*a* and extends toward a bottom 132 of the oil-gas barrel 130. The oil-gas separation cylinder 171 is generally located in an upper half portion of the internal space of the oil-gas barrel 130. An annular flow passage 10 is formed in the upper half portion of the internal space of the oil-gas barrel 130 between an inner wall surface 133 of the oil-gas barrel 130 and an outer wall surface 1711 of the oil-gas separation cylinder 171. The oil-gas flow passage 152*a* is communicated with the annular flow passage 10. In detail, the oil-gas separation cylinder 171 may be a hollow cylinder and has an oil-gas separation space 171*a* surrounded by the annular flow passage 10. A communication position 11 of the oil-gas flow passage 152*a* and the annular flow passage 10 is close to the top opening 131*a*. The oil-gas separation space 171*a* has a bottom opening 1712 facing the bottom 132. That is to say, the oil-gas separation space 171*a* communicates with the internal space of the oil-gas barrel 130 and also communicates with the annular flow passage 10.

The oil mist separator 180 is disposed on the barrel cover 172 and is disposed on the outside the barrel cover 172. In addition, the barrel cover 172 has an oil-gas port 1721. The oil-gas port 1721 communicates with the oil-gas separation space 171*a*. Therefore, the oil mist separator 180 may be communicated with the oil-gas separation space 171*a* through the oil-gas port 1721, and communicates with the internal space of the oil-gas barrel 130 through the oil-gas separation space 171*a*, and also communicates with the annular flow passage 10.

As shown in FIG. 1D, FIG. 1E, FIG. 2C and FIG. 2D, the lubricating oil injected or sprayed into the compression chamber 111 may mix with a gas entering the compression chamber 111, and be compressed by the first rotor 101 and the second rotor 102. Next, a mixed fluid formed by the lubricating oil and the compressed gas is discharged from the compression chamber 111 and flows into the oil-gas flow passage 152*a*. Since the oil-gas flow passage 152*a* extends toward the oil-gas barrel 130 along an arc path from bottom to top around the bearing assembly space 152*b*, the mixed fluid may be subjected to a centrifugal force during the process of the mixed fluid flowing toward the oil-gas barrel 130 in the oil-gas flow passage 152*a* to separate a portion of the lubricating oil from the compressed gas. This is a first oil-gas separation.

In the embodiment, the oil-gas flow passage 152*a* has a first port 1521 communicated with the compression chamber 111 and a second port 1522 communicated with the oil-gas barrel 130. In the gravity direction GD, there is a height difference H between the second port 1522 and the first port 1521. Specifically, the second port 1522 is higher than the first port 1521. Therefore, during the process of the mixed fluid flowing to the second port 1522 from the first port 1521, the lubricating oil separated from the compressed gas may be subject to the action of gravity and drip to a bottom of the oil-gas flow passage 152*a*.

Specifically, in order to allow an overall configuration of the compressor structure 100 to be more compatible to practical application needs, when a position of the top 131 of the oil-gas barrel 130 is higher than a height of the first port 1521 of the compression chamber 111, the second port 1522 of the oil-gas flow passage 152*a* is higher than the first port 1521 (that is, there is a height difference H between the second port 1522 and the first port 1521 in the gravity direction GD), so that the mixed fluid formed by the lubricating oil and the compressed gas may enter the oil-gas barrel 130 along the oil-gas flow passage 152*a* from bottom to top after being discharged from the compression chamber 111. In addition, when the position of the top 131 of the oil-gas barrel 130 is not higher than the height of the first port 1521 of the compression chamber 111, the second port 1522 of the oil-gas flow passage 152*a* is at a same height as the first port 1521 (that is, there is no height difference between the second port 1522 and the first port 1521 in the gravity direction GD), or the second port 1522 of the oil-gas flow passage 152*a* is lower than the first port 1521, so that the mixed fluid formed by the lubricating oil and the compressed gas may smoothly enter the oil-gas barrel 130 along the oil-gas flow passage 152*a* after being discharged from the compression chamber 111.

Next, as shown in FIG. 1E, FIG. 2C and FIG. 2E, the mixed fluid flows into the annular flow passage 10 from the second port 1522, and flows along a spiral path from the top 131 to the bottom 132 of the oil-gas barrel 130 in the annular flow passage 10 to separate most of the lubricating oil from the compressed gas through cyclone separation. This is a second oil-gas separation. At the same time, the lubricating oil may be subject to the action of gravity and drip to the bottom 132 of the oil-gas barrel 130. Since the oil-gas barrel 130 communicates with the oil tank 120, the lubricating oil may be further recovered to the oil tank 120.

As shown in FIG. 1E and FIG. 2E, after most of the lubricating oil is separated from the compressed gas, the compressed gas flows into the oil-gas separation space 171*a* from the bottom opening 1712, and then flows to the oil mist separator 180 from the oil-gas port 1721. In detail, the oil mist separator 180 may filter out tiny oil droplets remaining in the compressed gas to avoid the tiny oil droplets from entering the system with the compressed gas. This is a third oil-gas separation.

As shown in FIG. 1E, the oil-gas separation cylinder 171 is generally located in the upper half portion of the internal space of the oil-gas barrel 130. A lower half portion of the internal space of the oil-gas barrel 130 communicates with the oil tank 120. This design facilitates an increase of an oil storage capacity of the compressor structure 100. In addition, since the oil tank 120 is not directly communicated with the oil-gas flow passage 152*a*, the mixed fluid from the oil-gas flow passage 152*a* does not directly enter the oil tank 120, but first performs oil-gas separation in the oil-gas barrel 130 to enhance an oil-gas separation effect.

As shown in FIG. 1D, FIG. 1E, FIG. 2C and FIG. 2E, the bearing base 152 and the oil-gas barrel 130 are two connected casting members. The oil-gas flow passage 152*a* is located in the bearing base 152. The communication position 11 is located in the oil-gas barrel 130. Furthermore, the oil-gas flow passage 152*a* and the communication position 11 may compose an internal channel of the two casting members. One end of the internal channel (that is, the first port 1521 of the oil-gas flow passage 152*a*) is communicated with a gas outlet of the compression chamber 111. The other end of the internal channel (that is, the communication position 11) is communicated with the oil-gas barrel 130 facing a tangential direction of the outer wall surface of the oil-gas barrel 130 (i.e., in a direction parallel to the tangential direction of the outer wall surface 1711 of the oil-gas separation cylinder 171).

As shown in FIG. 1A, FIG. 1B, FIG. 1C and FIG. 1E, in the embodiment, the oil tank 120 is disposed under the compressor housing 110. The oil-gas barrel 130 is disposed on a side of the oil tank 120. Based on this configuration, an extension path of the oil-gas flow passage 152*a* communicating with the oil-gas barrel 130 is an arc path surrounding the bearing assembly space 152*b*. The bearing assembly space 152*b* and the arc path may be on a same plane in space.

As shown in FIG. 1B, FIG. 1E, FIG. 1F and FIG. 2C, in the embodiment, the compressor structure 100 further includes a first external oil path 190, a second external oil path 191, a third external oil path 192 and at least one fourth external oil path 193. In detail, the bottom 132 of the oil-gas barrel 130 has a communication port 134. One end of the first external oil path 190 is connected to the communication port 134. The other end of the first external oil path 190 is connected to an external cooler 20. That is to say, the oil-gas barrel 130 is communicated with the external cooler 20 through the first external oil path 190.

On the other hand, the motor 140 includes a motor housing 141. The motor housing 141 has a cooling flow passage 141*a*. The cooling flow passage 141*a* has a first flow passage opening 141*b* and a second flow passage opening 141*c* that are opposite to each other. In detail, one end of the second external oil path 191 is connected to the external cooler 20. The other end of the second external oil path 191 is connected to the first flow passage opening 141*b*. That is to say, the external cooler 20 is communicated with the motor 140 through the second external oil path 191, specifically communicated with the cooling flow passage 141*a* of the motor housing 141.

In the embodiment, the oil filter base 151 has a communication port 151*b*. One end of the third external oil path 192 is connected to the second flow passage opening 141*c*. The other end of the third external oil path 192 is connected to the communication port 151*b*. That is to say, the motor 140 is communicated with the oil filter 160 through the third external oil path 192. Specifically, the cooling flow passage 141*a* of the motor housing 141 is communicated with the oil filter 160 through the third external oil path 192 and the oil filter base 151.

Specifically, the first flow passage opening 141*b* connected to the external cooler 20 may be an inlet of the cooling flow passage 141*a*. Correspondingly, the second flow passage opening 141*c* connected to the oil filter base 151 may be an outlet of the cooling flow passage 141*a*. In other examples, the external cooler 20 may be connected to the second flow passage opening 141*c*, and the oil filter base 151 may be connected to the first flow passage opening 141*b*, so that the second flow passage opening 141*c* serves as the inlet of the cooling flow passage 141*a*, and the first flow passage opening 141*b* serves as the outlet of the cooling flow passage 141*a*. That is to say, the inlet and the outlet of the cooling flow passage 141*a* may be interchangeably disposed according to actual application needs, which does not affect a cooling effect of the motor 140.

Figure 1F:
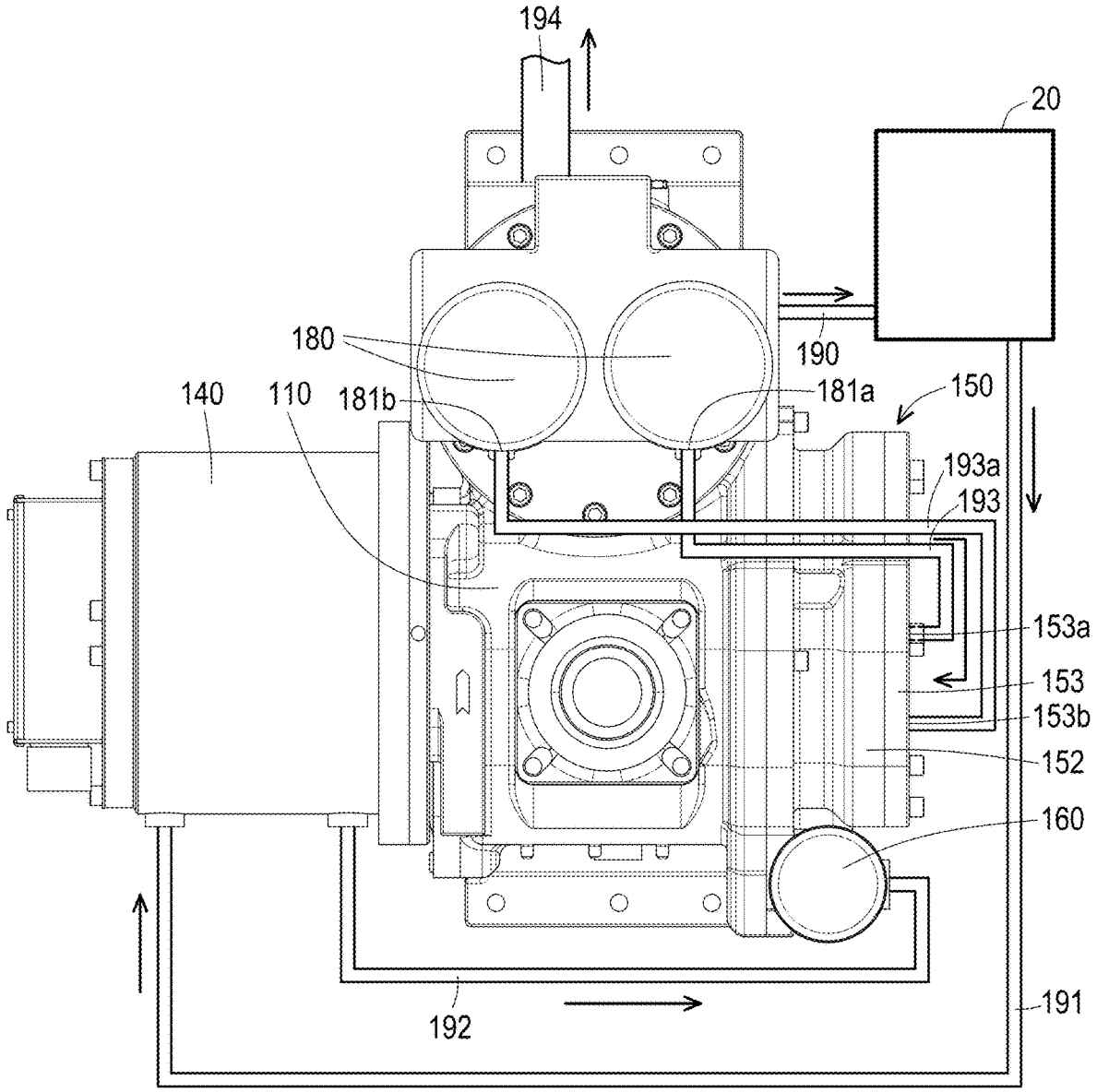
FIG. 1F is a schematic top view of a flow path of the compressor structure of FIG. 1A.

As shown in FIG. 1B and FIG. 1F, in the embodiment, the bearing assembly space 152*b* of the first assembly base 150 is covered or closed by the bearing base cover 153. The bearing base cover 153 has two communication ports 153*a* and 153*b*. On the other hand, two oil mist separators 180 are disposed on the second assembly base 170, and are respectively communicated with the first assembly base 150 through two fourth external oil paths 193 and 193*a*, specifically communicated with the bearing assembly space 152*b*.

Furthermore, the oil mist separator 180 relatively close to the first assembly base 150 has a communication port 181*a*, while the other oil mist separator 180 relatively away from the first assembly base 150 has a communication port 181*b*. One end of the fourth external oil path 193 is connected to the communication port 181*a*. The other end of the fourth external oil path 193 is connected to the communication port 153*a* relatively close to the two oil mist separators 180. In addition, one end of the fourth external oil path 193*a* is connected to the communication port 181*b*. The other end of the fourth external oil path 193*a* is connected to the communication port 153*b* relatively away from the two oil mist separators 180.

As shown in FIG. 1B, FIG. 1E, FIG. 1F and FIG. 2C, the lubricating oil stored in the oil-gas barrel 130 may be transported to the external cooler 20 through the first external oil path 190 to perform cooling. Next, the lubricating oil after being cooled may be transported to the cooling flow passage 141*a* of the motor housing 141 through the second external oil path 191 to perform cooling on the motor 140, preventing failure or damage of the motor 140 due to an excessively high operation temperature.

Then, the lubricating oil in the cooling flow passage 141*a* may be transported to the oil filter 160 through the third external oil path 192 and the oil filter base 151. Solid impurities in the lubricating oil may be filtered out through the oil filter 160. Next, as shown in FIG. 2B to FIG. 2D, the lubricating oil is transported to the first internal oil path 151*a* from the oil filter 160, and then transported to the second internal oil path 112 from the first internal oil path 151*a*. Then, the lubricating oil is injected or sprayed into the compression chamber 111 through the first oil injection hole 113 and the second oil injection hole 114 from the second internal oil path 112 to perform lubrication and cooling on the first rotor 101 and the second rotor 102.

Then, as shown in FIG. 1D, FIG. 1E, FIG. 2C and FIG. 2E, the mixed fluid formed by the lubricating oil and the compressed gas is discharged from the compression chamber 111, and sequentially flows through the oil-gas flow passage 152*a* and the annular flow passage 10 to sequentially perform the first oil-gas separation and the second oil-gas separation. Next, the compressed gas flows into the oil-gas separation space 171*a* from the bottom opening 1712, and then flows to the two oil mist separators 180 from the oil-gas port 1721 to perform the third oil-gas separation.

As shown in FIG. 1B, FIG. 1F and FIG. 2E, after the two oil mist separators 180 filter out the tiny oil droplets remaining in the compressed gas, the oil droplets may be transported to the bearing assembly space 152*b* through the two fourth external oil paths 193 and 193*a* to perform lubrication on the first bearing 103 and the second bearing 104. As shown in FIG. 1A, FIG. 1F and FIG. 2E, the oil mist separator 180 has a communication port 182 connected to an external gas path 194 to be communicated with a system through the external gas path 194. After the two oil mist separators 180 filter out the tiny oil droplets remaining in the compressed gas, the compressed gas with low oil content may be transported to the system through the external gas path 194.

Through the flow path design of the compressor structure 100, the lubricating oil may be fully used and recovered, and most of the lubricating oil may be separated from the compressed gas to prevent the compressed gas with high oil content from entering the system, while decreasing the consumption of the lubricating oil.

In the embodiment, after the two oil mist separators 180 individually filter out the tiny oil droplets remaining in the compressed gas, the oil droplets may enter the fourth external oil path 193 through the communication port 181*a*. At the same time, the oil droplets may enter the fourth external oil path 193*a* through the communication port 181*b*. Then, the oil droplets may be transported to the communication port 153*a* through the fourth external oil path 193 to be transported to the bearing assembly space 152*b* through the communication port 153*a*. At the same time, the oil droplets may be transported to the communication port 153*b* through the fourth external oil path 193*a* to be transported to the bearing assembly space 152*b* through the communication port 153*b*. Therefore, the oil droplets filtered by the two oil mist separators 180 may be transported to the bearing assembly space 152*b* through two transport paths.

In other examples, the two oil mist separators 180 may share a single communication port. The bearing base cover 153 has a single communication port. On the other hand, the communication port shared by the two oil mist separators 180 is connected to a communication port of the bearing base cover 153 through a single fourth external oil path to be communicated with the bearing assembly space 152*b*. Therefore, the oil droplets filtered by the two oil mist separators 180 may be transported to the bearing assembly space 152*b* through a single transport path.

In other examples, two communication ports of the two oil mist separators 180 are respectively connected to two fourth external oil paths. The two fourth external oil paths are connected to one communication port of the bearing base cover 153 through a common valve or a common communication pipe. In practical applications, the communication ports and one or multiple compatible fourth external oil paths of the oil mist separators 180 and the bearing base cover 153 may be configured according to the design needs of different compressor models.

Please refer to FIG. 1E and FIG. 2C to FIG. 2E. In the embodiment, the oil-gas barrel 130 further includes an oil sight glass 135. The oil sight glass 135 is disposed between the top 131 and the bottom 132, and is close to the lower half portion of the oil-gas barrel 130 to facilitate an observation of a liquid level of the lubricating oil stored in the oil-gas barrel 130, thereby determining an inventory of the lubricating oil. On the other hand, two rectifying plates 136 extending from the bottom 132 to the top 131 are disposed on the inside of the oil-gas barrel 130. The two rectifying plates 136 are located between the oil sight glass 135 and the oil tank 120.

When the mixed fluid performs cyclone separation in the annular flow passage 10 or when the lubricating oil drips toward the bottom 132, a liquid surface of the lubricating oil stored in the oil-gas barrel 130 may be disturbed, allowing the liquid surface to fluctuate. Since the two rectifying plates 136 may block or attenuating the fluctuation transmitted toward the oil sight glass 135, preventing an excessive undulation of the liquid level of the lubricating oil close to the oil sight glass 135 to decrease a condition where the inventory of the lubricating oil is misjudged.

Figure 3:
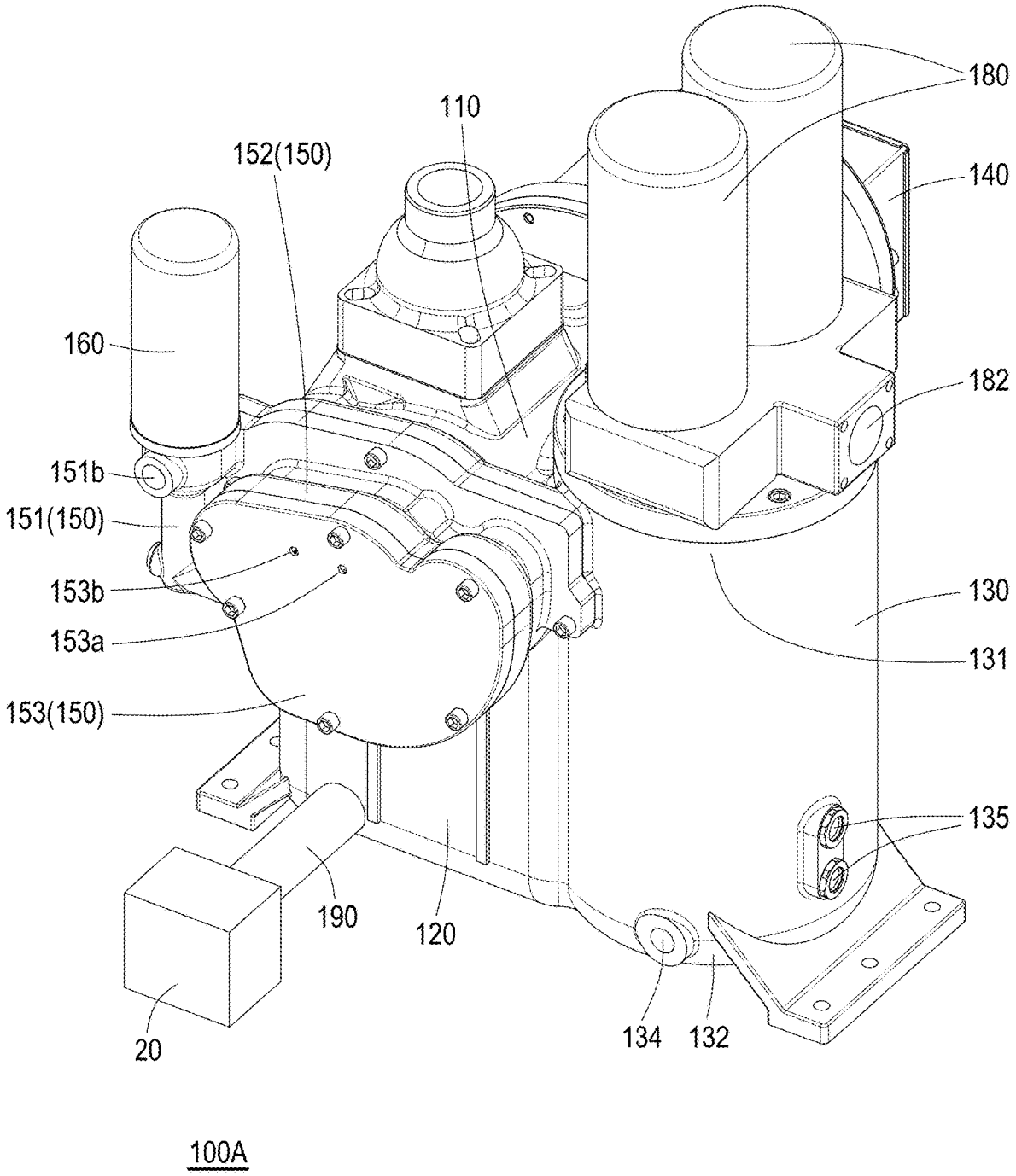
FIG. 3 is a schematic view of a configuration of an oil tank and an external cooler of a compressor structure according to another embodiment of the disclosure.

FIG. 3 is a schematic view of a configuration of an oil tank and an external cooler of a compressor structure according to another embodiment of the disclosure. In the compressor structure 100 of the previous embodiment, the oil-gas barrel 130 is communicated with the external cooler 20 through the first external oil path 190. Please refer to FIG. 3. In a compressor structure 100A of the embodiment, the first external oil path 190 may be connected between the oil tank 120 and the external cooler 20. That is to say, the oil tank 120 is communicated with the external cooler 20 through the first external oil path 190 to transport the lubricating oil stored in the oil tank 120 to the external cooler 20 through the first external oil path 190 to perform cooling.

Figure 4:
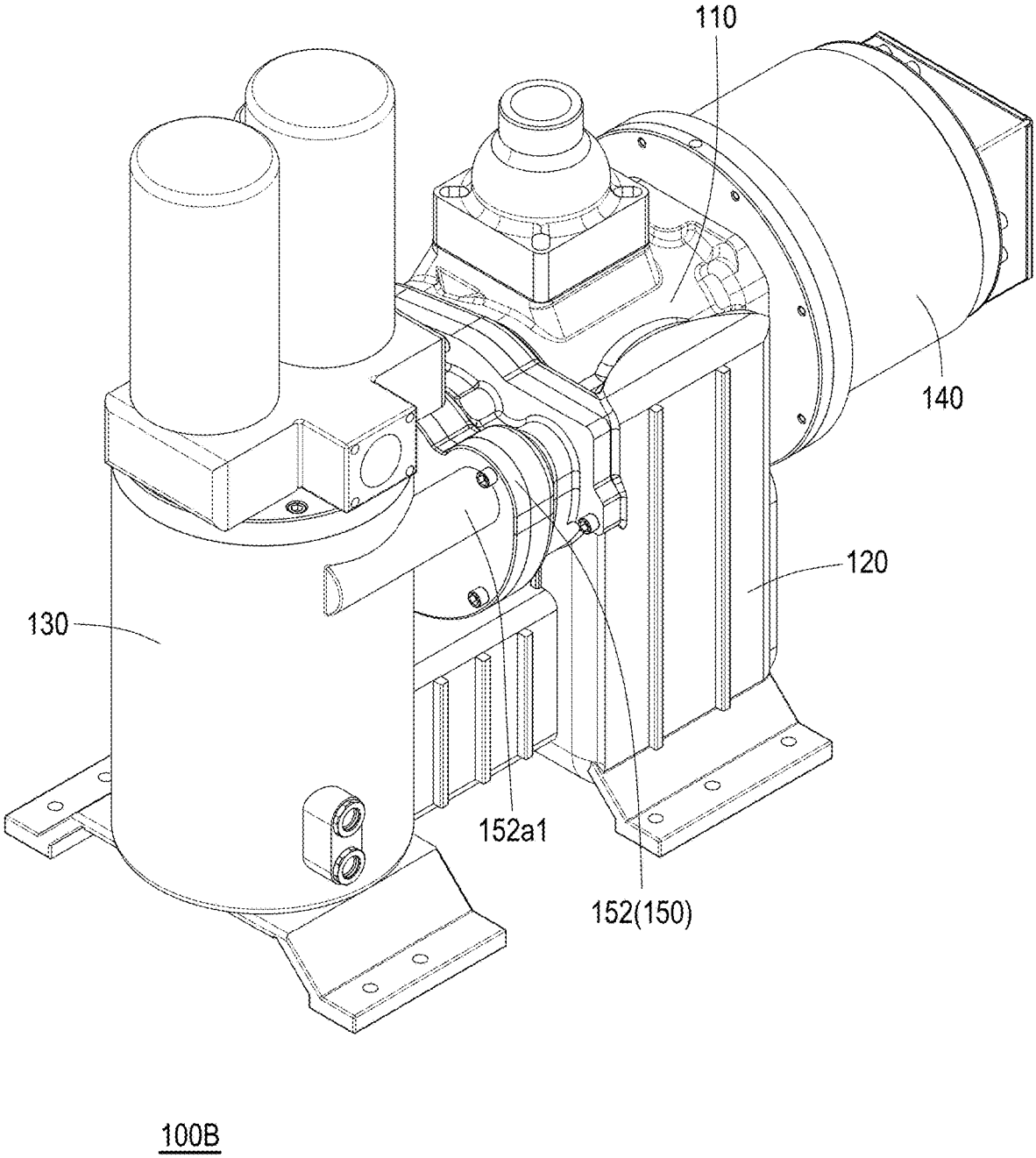
FIG. 4 is a schematic view of a compressor structure according to yet another embodiment of the disclosure.

FIG. 4 is a schematic view of a compressor structure according to yet another embodiment of the disclosure. Please refer to FIG. 4. Different from the compressor structure 100 shown in FIG. 1A to FIG. 1C, in a compressor structure 100B of the embodiment, the motor 140 and the first assembly base 150 are respectively disposed on opposite sides of the compressor housing 110. The bearing base 152 is disposed between the oil-gas barrel 130 and the compressor housing 110. That is to say, the oil-gas barrel 130 is disposed opposite to the motor 140 through the bearing base 152. Based on this configuration, an oil-gas flow passage 152*a*1 extends toward the oil-gas barrel 130 from the bearing base 152 to communicate with the oil-gas barrel 130, and is on different planes in space with the bearing base 152 and the bearing assembly space inside.

In summary, in the compressor structure of the disclosure, the mixed fluid formed by the lubricating oil and the compressed gas may first perform the first oil-gas separation through the centrifugal force in the oil-gas flow passage after being discharged from the compression chamber. Next, the mixed fluid enters the oil-gas barrel from the oil-gas flow passage and performs the second oil-gas separation through cyclone separation in the oil-gas barrel to separate most of the lubricating oil from the compressed gas. Next, the compressed gas flows into the oil-gas separation space from the bottom opening, and then flows to the oil mist separator from the oil-gas port to perform the third oil-gas separation. That is to say, different from the conventional compressor structure that directly transports the mixed fluid into the oil tank from the compression chamber to perform oil-gas separation, the compressor structure of the disclosure utilizes a three-stage oil-gas separation procedure to significantly decrease an oil content of the compressed gas. Therefore, the compressor structure of the disclosure can not only prevent the compressed gas with high oil content from entering the system, but also can decrease the consumption of the lubricating oil.

Furthermore, in the compressor structure of the disclosure, the oil filter and the oil mist separator are designed to be external, which facilitates an enhancement of the compactness of the structural configuration to reduce volume. On the other hand, the compressor housing, the oil tank, and the oil-gas barrel are integrally cast and formed, which can not only significantly improve structural strength, decrease assembly processes, improve manufacturing efficiency and reduce manufacturing costs, but also can improve sealing performance to effectively decrease the oil-gas leakage phenomenon. The advantage of utilizing a structure integrally cast and formed is that relative positions of the compressor housing, the oil tank, and the oil-gas barrel may be changed according to actual application needs, and the oil tank and the oil-gas barrel that communicate facilitate an increase of oil storage capacity. In addition, the lubricating oil after being cooled may first perform cooling on the motor, and then be injected or sprayed into the compression chamber to perform lubrication and cooling on the first rotor and the second rotor, significantly improving an integration of the oil paths and a usage rate of the lubricating oil.

Although the disclosure has been disclosed in the above embodiments, the embodiments are not intended to limit the disclosure. Persons skilled in the art may make some changes and modifications without departing from the spirit and scope of the disclosure. Therefore, the protection scope of the disclosure shall be defined by the appended claims.

What is claimed is:

1. A compressor structure, comprising:

a compressor housing, having a compression chamber;

an oil tank;

an oil-gas barrel, integrally cast and formed with the compressor housing and the oil tank;

a motor;

a first assembly base, respectively disposed on opposite sides of the compressor housing with the motor, wherein the first assembly base has an oil-gas flow passage, and the compression chamber communicates with the oil-gas barrel through the oil-gas flow passage;

at least one oil filter, disposed on the first assembly base, and communicating with the compression chamber through the first assembly base;

a second assembly base, disposed on the oil-gas barrel; and at least one oil mist separator, disposed on the second assembly base, and communicating with the oil-gas barrel through the second assembly base.

2. The compressor structure according to claim 1, wherein the oil-gas barrel comprises a top and a bottom, and the top has a top opening, the second assembly base is disposed on the top and covers the top opening, the second assembly base comprises an oil-gas separation cylinder, and the oil-gas separation cylinder is inserted into the oil-gas barrel from the top opening and extends toward the bottom.

3. The compressor structure according to claim 2, wherein an annular flow passage is formed between an inner wall surface of the oil-gas barrel and an outer wall surface of the oil-gas separation cylinder, and the oil-gas flow passage communicates with the annular flow passage.

4. The compressor structure according to claim 3, wherein a communication position of the oil-gas flow passage and the annular flow passage is close to the top opening, and the oil-gas separation cylinder has an oil-gas separation space surrounded by the annular flow passage, and the oil-gas separation space has a bottom opening facing the bottom.

5. The compressor structure according to claim 4, wherein the oil mist separator communicates with the oil-gas barrel through the oil-gas separation space.

6. The compressor structure according to claim 5, wherein the second assembly base further comprises a barrel cover connected to the oil-gas separation cylinder, and the barrel cover covers the top opening, the oil mist separator is disposed on the barrel cover, wherein the barrel cover has an oil-gas port, and the oil mist separator communicates with the oil-gas separation space through the oil-gas port.

7. The compressor structure according to claim 6, wherein the oil-gas separation cylinder and the barrel cover are integrally cast and formed.

8. The compressor structure according to claim 4, wherein the oil-gas flow passage and the communication position compose an internal channel, one end of the internal channel communicates with a gas outlet of the compression chamber, and the other end of the internal channel communicates with the oil-gas barrel facing a tangential direction of the outer wall surface of the oil-gas barrel.

9. The compressor structure according to claim 1, wherein the first assembly base comprises an oil filter base and a bearing base, and the oil filter base and the bearing base are integrally cast and formed, the oil filter is disposed on the oil filter base and communicates with the compression chamber through the oil filter base, the first assembly base further has a bearing assembly space separated from the oil-gas flow passage, and the oil-gas flow passage and the bearing assembly space are formed in the bearing base.

10. The compressor structure according to claim 9, further comprising:

a first rotor, coupled to the motor;

a second rotor, disposed in the compression chamber with the first rotor, and engaging with each other; and a first bearing and a second bearing, disposed in the bearing assembly space, wherein an end of the first rotor is inserted into the bearing assembly space, and the first bearing is sleeved on the end of the first rotor, an end of the second rotor is inserted into the bearing assembly space, and the second bearing is sleeved on the end of the second rotor, the first assembly base further comprises a bearing base cover, wherein the bearing base cover is disposed on the bearing base and covers the bearing assembly space and the oil-gas flow passage.

11. The compressor structure according to claim 9, wherein the oil filter base has a first internal oil path, and the compressor housing further has a second internal oil path communicating with the compression chamber, the first internal oil path communicates with the second internal oil path, and the oil filter communicates with the compression chamber through the first internal oil path and the second internal oil path.

12. The compressor structure according to claim 9, wherein the oil tank is disposed under the compressor housing, and the oil-gas barrel is disposed opposite to the motor through the bearing base.

13. The compressor structure according to claim 1, wherein the oil-gas flow passage extends along an arc path and has a first port communicating with the compression chamber and a second port communicating with the oil-gas barrel.

14. The compressor structure according to claim 13, wherein there is a height difference between the second port and the first port in a gravity direction.

15. The compressor structure according to claim 1, further comprising:

a first external oil path, wherein the oil-gas barrel communicates with an external cooler through the first external oil path;

a second external oil path, wherein the external cooler communicates with the motor through the second external oil path;

a third external oil path, wherein the motor communicates with the oil filter through the third external oil path; and at least one fourth external oil path, wherein the oil mist separator communicates with the first assembly base through the fourth external oil path.

16. The compressor structure according to claim 15, wherein the first assembly base further has a bearing assembly space separated from the oil-gas flow passage, and the fourth external oil path communicates with the bearing assembly space.

17. The compressor structure according to claim 15, wherein the motor comprises a motor housing, and the motor housing has a cooling flow passage, the external cooler communicates with an inlet of the cooling flow passage through the second external oil path, and an outlet of the cooling flow passage communicates with the oil filter through the third external oil path.

18. The compressor structure according to claim 1, wherein the oil tank is disposed under the compressor housing, and the oil-gas barrel is disposed on a side of the oil tank.

19. The compressor structure according to claim 1, wherein a lower half portion of an internal space of the oil-gas barrel communicates with the oil tank.

20. The compressor structure according to claim 1, further comprising:

an external oil path, wherein the oil tank communicates with an external cooler through the external oil path.

* * * * *